US006852046B1

(12) United States Patent
Wewel et al.

(10) Patent No.: US 6,852,046 B1
(45) Date of Patent: Feb. 8, 2005

(54) SELF-STORING STANDARD FOR A GAME NET

(76) Inventors: Joseph S. Wewel, 605 Thornbird Dr., Fremont, NE (US) 68025-6446; Dana G. Rosenburg, 3106 Memphis Pl., Grand Island, NE (US) 68803-4156; Beau D. Kuipers, 527 Nebraska Hall, Lincoln, NE (US) 68588-0601

( * ) Notice: Subject to any disclaimer, the term of this patent is extended or adjusted under 35 U.S.C. 154(b) by 0 days.

(21) Appl. No.: 10/614,841

(22) Filed: Jul. 8, 2003

(51) Int. Cl.[7] ..... A61B 61/04
(52) U.S. Cl. ..... 473/463; 473/492
(58) Field of Search ..... 473/490–494; 248/530; 52/736.1, 736.3, 736.4, 726.3, 726.4

(56) References Cited

U.S. PATENT DOCUMENTS

| | | | | | |
|---|---|---|---|---|---|
| 1,599,071 | A | | 9/1926 | Warren | |
| 1,959,574 | A | | 5/1934 | Dunscombe | |
| 2,142,647 | A | | 1/1939 | Heller | |
| 3,195,898 | A | * | 7/1965 | Respini | 473/197 |
| 3,383,108 | A | | 5/1968 | Reilly, Jr. | |
| 3,645,370 | A | * | 2/1972 | Rodwell et al. | 194/241 |
| 4,122,451 | A | * | 10/1978 | Senoh | 473/492 |
| 4,513,938 | A | | 4/1985 | Seymour | |
| 4,732,395 | A | * | 3/1988 | Halverson | 473/492 |
| 4,844,477 | A | * | 7/1989 | Pardi | 473/493 |
| 5,238,251 | A | | 8/1993 | Staka | |
| 5,242,174 | A | | 9/1993 | Koole | |
| 6,155,937 | A | | 12/2000 | Alter | |

FOREIGN PATENT DOCUMENTS

| | | | |
|---|---|---|---|
| DE | 3523568 | * | 1/1987 |
| GB | 2107199 | * | 4/1983 |

* cited by examiner

*Primary Examiner*—Raleigh W. Chiu
(74) *Attorney, Agent, or Firm*—Thomte, Mazour & Niebergall; Shane M. Niebergall

(57) ABSTRACT

A standard for supporting a game net above a playing surface is provided with an internal net tensioning system which allows the standard to be stored beneath the playing surface. A plurality of pre-set height stops are provided along the length of the standard to allow the net to be set at one of several different heights to accommodate the playing of different games by different playing abilities. Power cylinder mechanics permits the automatic raising and lowering of the standard with respect to the playing surface. A quick attachment system is provided for quickly and easily engaging and disengaging the net from the standard.

24 Claims, 7 Drawing Sheets

SELF-STORING STANDARD FOR A GAME NET

BACKGROUND OF THE INVENTION

The present invention relates to standards for game nets, and more particularly to an a self-storing standard that is height adjustable for different games and abilities of players.

DESCRIPTION OF THE PRIOR ART

Game nets are crucial pieces of equipment for playing various sports, such as volleyball, badminton and tennis. The net is typically supported by a pair of vertically disposed standards that are spaced horizontally from one another. Tension is applied to the net in order to ensure that it is tautly supported for proper playing conditions. Oftentimes, the playing surface where these nets are used may have to be used for several different sports and activities. One typical example of such a playing surface may be the floor of a gymnasium. Due to the fact that gymnasiums are used for so many different activities, the net standards are rarely permanently disposed on the gymnasium floor. A typical prior art method of supporting the standards uses a weighted stand that receives the lower end of a standard and holds the same in position. The stand is releasably placed on top of the playing surface. The stands are often rolled into and out of position using a pair of wheels affixed to one end of the stand. Another prior art method of engaging standards with the playing surface involves a locking ring or collar permanently disposed in the gymnasium floor that releasably receives the lower end portion of each standard. With each of these prior art methods, however, the net and standards must be removed and stored in an equipment room when they are not in use.

One prior art method for dealing with the issue of storing net standards is disclosed within U.S. Pat. No. 5,242,174. That patent discloses a net standard that is telescopically received beneath the playing surface. However, that system suffers from a number of deficiencies. First, the system lacks a good method for tensioning the net. To be sure, prior art methods of tensioning the net incorporate bulky wheels and gear systems that are disposed on the outer surface of the standard, rendering the same too large to be telescopically stored beneath the playing surface. The system disclosed by the '174 patent is also inflexible in that it is built to provide a single "volleyball" height for supporting the net. There is no easy means for altering the height for youth league or lowering the height of the net to be adjacent the playing surface for playing tennis. Finally, the disclosed system must be raised and lowered manually, which can be tedious, if not impossible, for some individuals. Moreover, the manual raising and lowering of the net system increases the risk of personal injury.

Other prior art systems have been provided for raising and lowering the height of the net. However, these systems have not been incorporated within a net standard that is fully retractable beneath the playing surface. Moreover, these systems typically raise and lower the net along the length of the net standard, leaving a substantial portion of the standard disposed above the top of the net in many of the lower height settings. These types of systems are also undesirable for the reason that the mechanisms used for raising and lowering the net are bulky and oftentimes increase the risk of personal injury.

Accordingly, what is needed is a standard for supporting a game net that is self-storing beneath the playing surface but is also provided with an adequate net tensioning system and the ability to adjust between several pre-set net heights.

SUMMARY OF THE INVENTION

The standard for supporting a game net of the present invention is generally provided with an elongated net support having a net tensioning system disposed therein. The net support is telescopically received within, and is extendable from, an elongated lower support. Both the net support and lower support are telescopically received within, and extendable from, a housing that is disposed beneath the playing surface. Power cylinder mechanics is preferably used for the automatic raising and lowering of the standard.

The tensioning system is operated using a removable handle, allowing the user to properly tension the net prior to play and telescopically store the standard beneath the playing surface once play has been completed. Supplementary net tensioning is provided to the lower end portion of the net using a simple ratchet pulley that is coupled to the lower support line of the net. The lower support line quickly and easily engages the standard via a keyhole coupling system. The standard is preferably disposed so that it is positioned at an angle with respect to the perpendicular when it is disposed above the ground. Accordingly, when the proper tension is applied to the net, the standard is "pulled" into proper perpendicular alignment with the playing surface.

The standard is provided with a plurality of pre-set stops for setting the net at a number of different heights for different abilities and games to be played. Regardless of the height at which the net is positioned, the standard is positioned ito generally extend no higher than the top of the net.

It is therefore one of the principal objects of the present invention to provide a standard for game nets that is self-storing beneath a playing surface.

It is another object of the present invention to provide a standard for a game net with a net tensioning system that is disposed within the standard to allow for easy storage of the standard beneath a playing surface.

Yet another object of the present invention is to provide a standard for a game net that is easily raised above and stored beneath a playing surface using power cylinder mechanics.

Still another object of the present invention is to provide a standard for game nets having a plurality of pre-set net heights for various games and playing abilities.

Yet another object of the present invention is to provide a standard for game nets with a system for adjusting the height of the net with respect to the playing surface that prevents the standard from projecting above the height of the net at any net height setting.

A further object of the present invention is to provide a standard for game nets that is provided with a supplemental net tensioning system that quickly and easily couples the lower end portion of the net to the standard.

Still another object of the present invention is to provide a standard for game nets that is simple in construction and use.

These and other objects of the present invention will be clear to those of skill in the art.

DESCRIPTION OF THE PREFERRED EMBODIMENT

Figure 1:
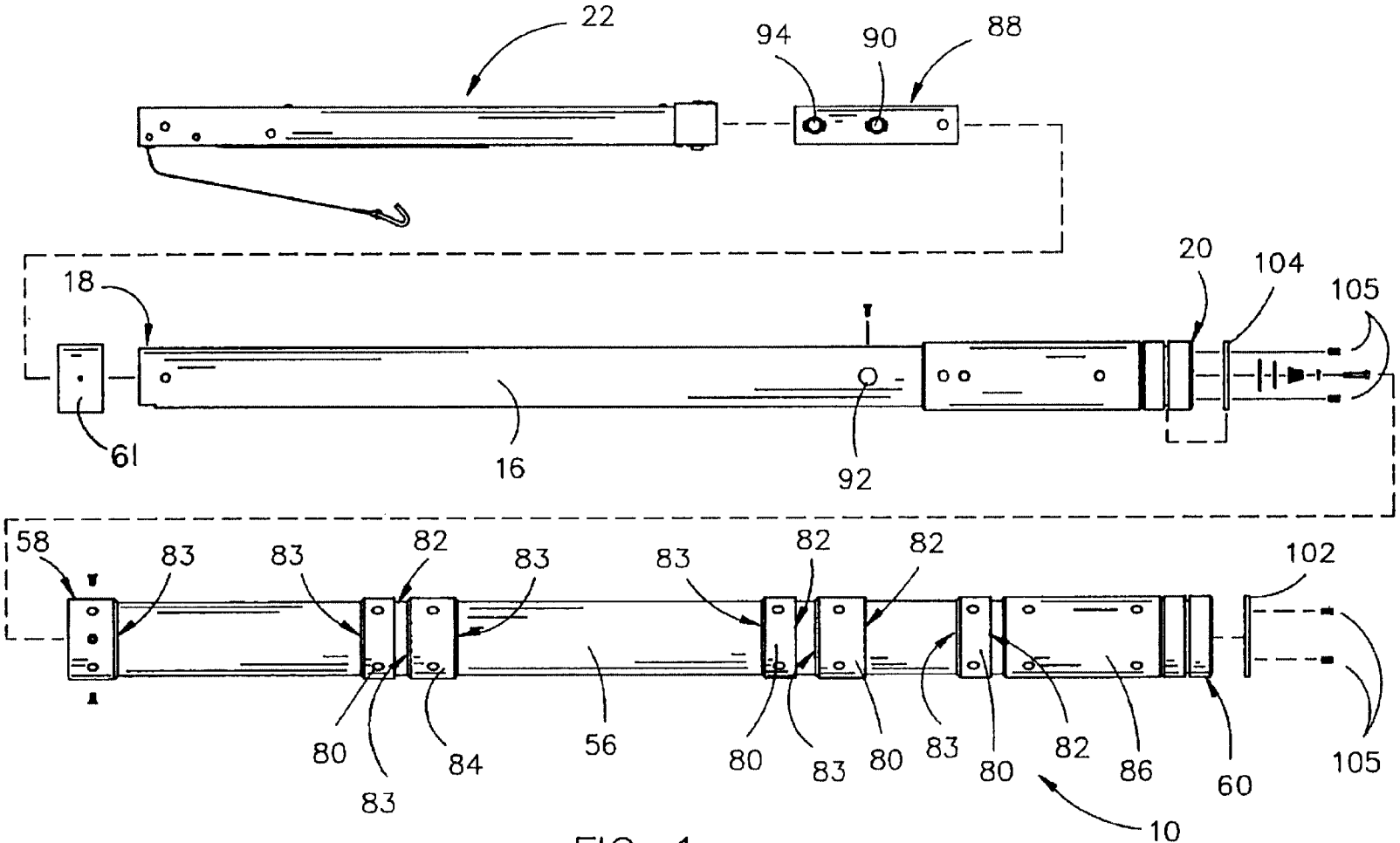
FIG. 1 is a partial exploded view of one embodiment of the standard of the present invention.
Figure 6C:
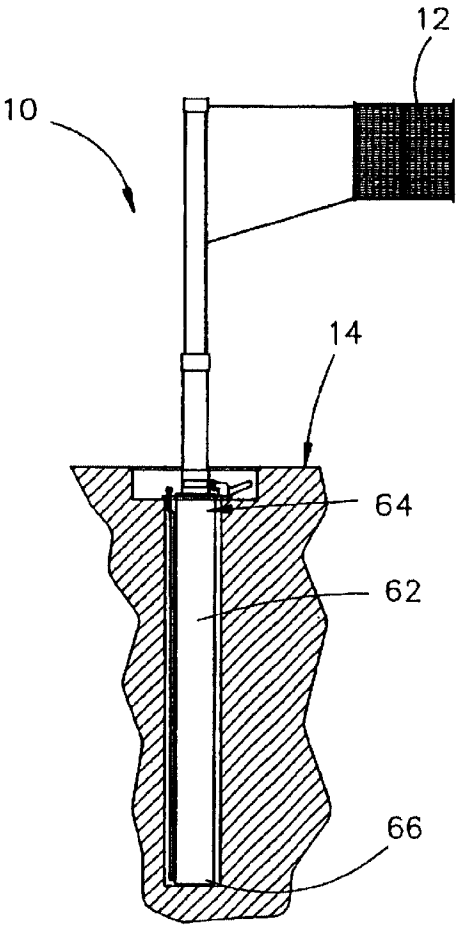
FIG. 6C is a partial side elevation view of the standard of FIG. 6A, as the same may be set at a youth league volleyball height.
Figure 6B:
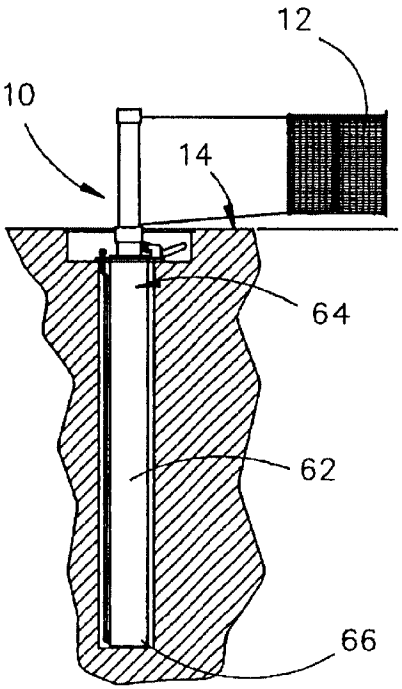
FIG. 6B is a partial side elevation view of the standard of FIG. 6A, as the same may be set at a regulation tennis height.
Figure 6A:
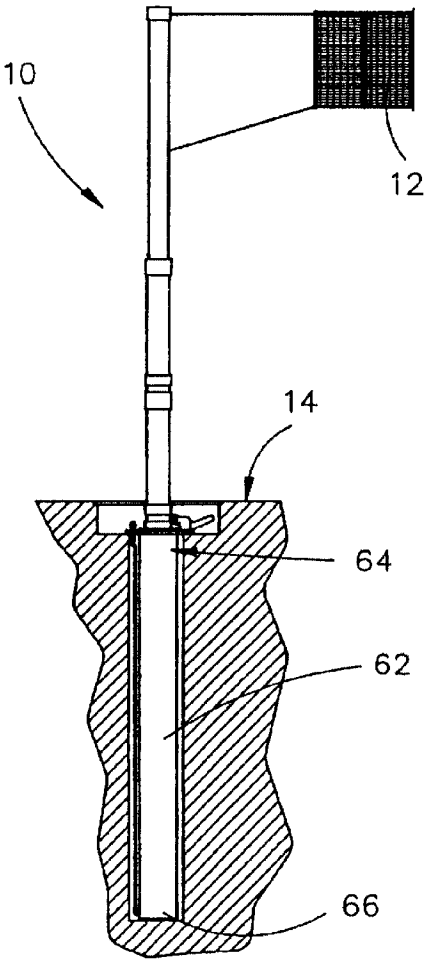
FIG. 6A is a partial side elevation view of one embodiment of the standard of the present invention, as the same may be set at a regulation volleyball height.

The standard 10 of the present invention is generally depicted in FIG. 1 and in FIGS. 6A–6C as the same might be used to support a game net 12. However, it is contemplated that the standard 10 could be used in several different applications, including, but not limited to, supporting a flag, a banner, or even serving as a simple microphone stand. For ease of description herein, the same will be described simply as it could be used for supporting a game net 12 above a playing surface 14.

Figure 2:
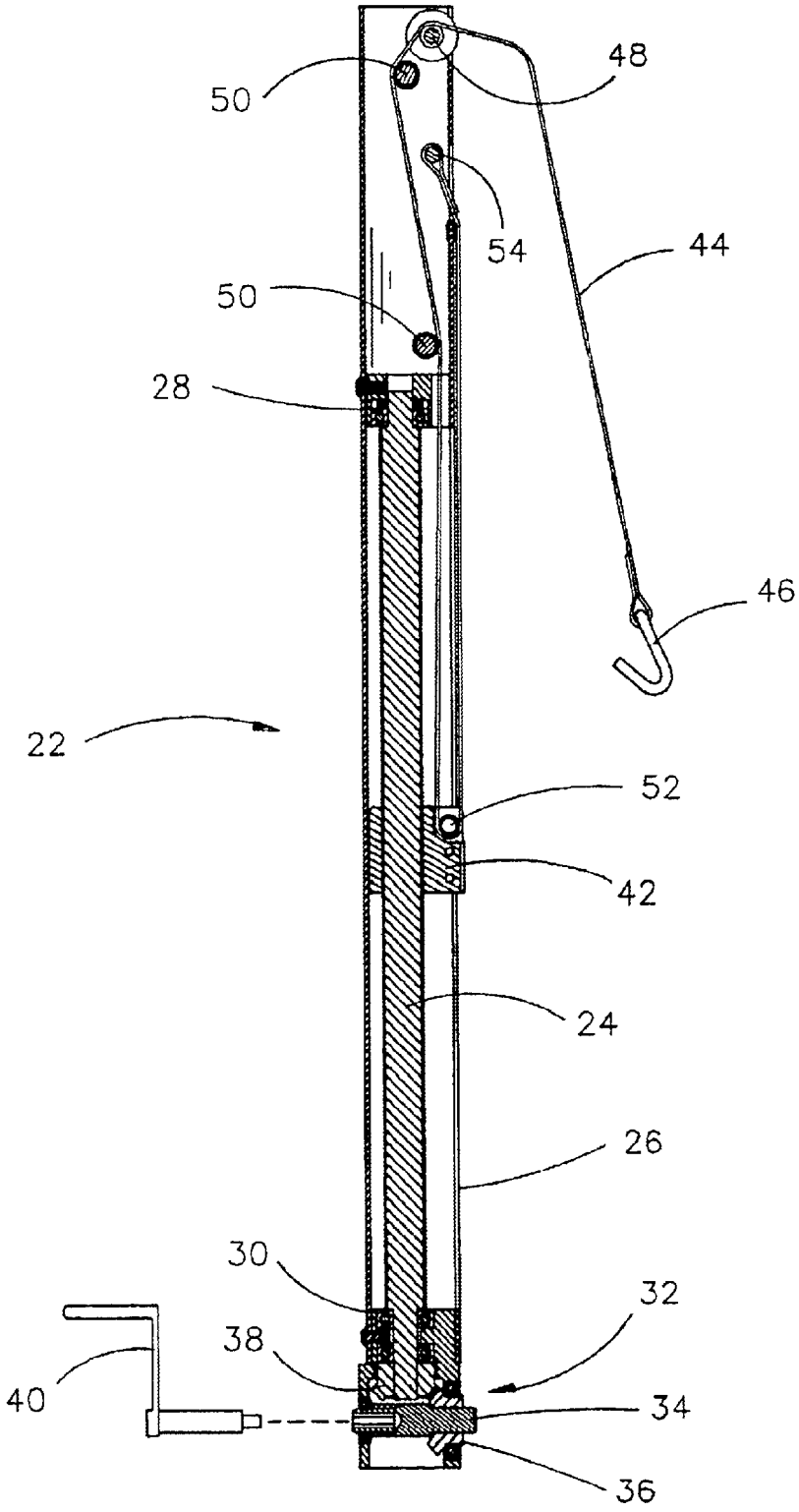
FIG. 2 is a partial cut-away view of one embodiment of the net tensioning system of the present invention.
Figure 3:
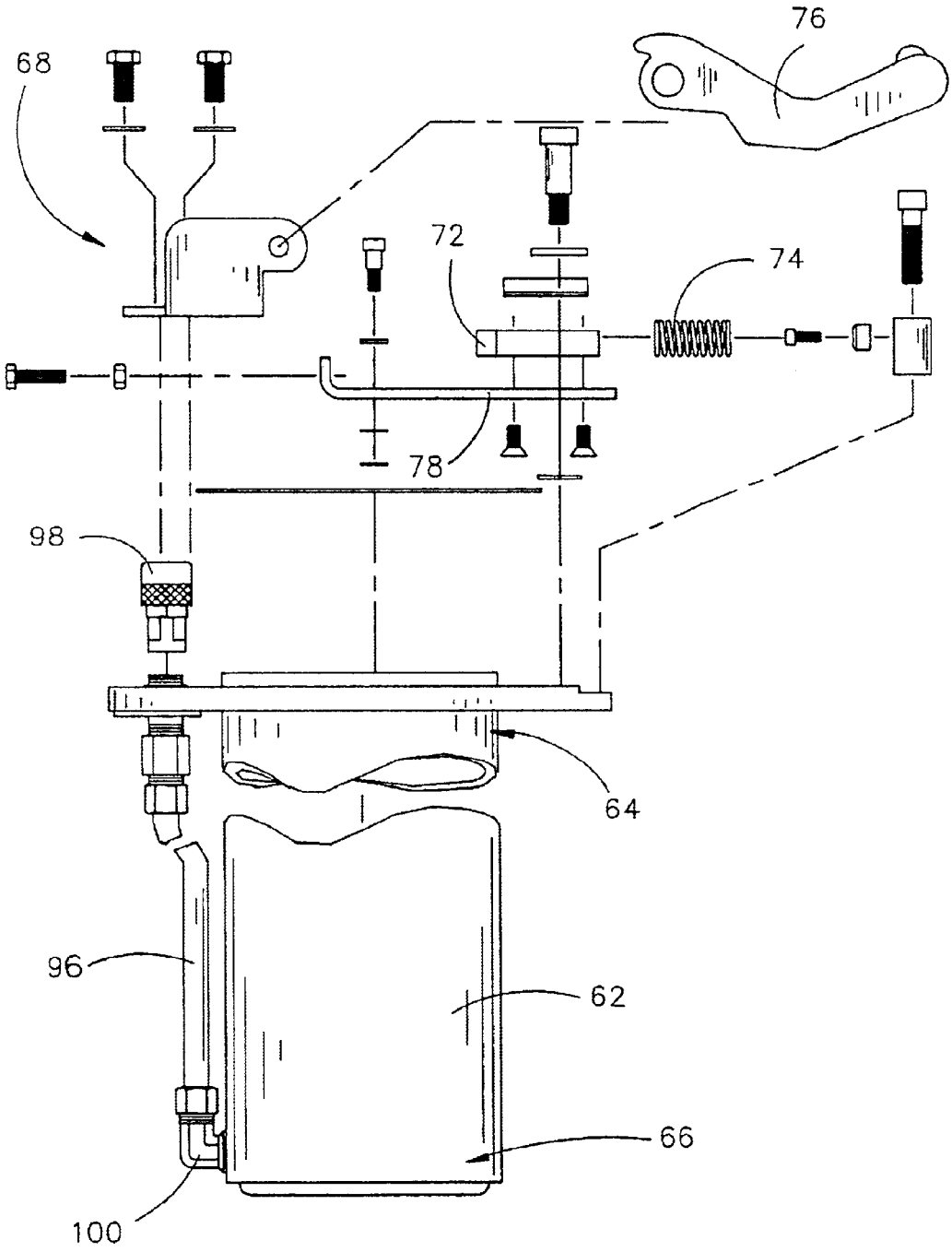
FIG. 3 is a partial exploded view of one embodiment of the base receptacle assembly of the present invention.

The standard 10 is generally comprised of at least an elongated net support 16 having an upper end 18 and a lower end portion 20. A net tensioning system 22, which is depicted in FIGS. 1 and 2, is preferably secured within the interior portion of the net support 16. The net tensioning system 22 is preferably provided with an elongated tensioning screw 24 having mating threads disposed along its length. The tensioning screw 24 is generally coaxially disposed within the outer tube 26 of the net tensioning system 22. The tensioning screw 24 is rotatably supported within the tube 26 at its opposite ends using a first bearing assembly 28 and a second bearing assembly 30. A gear box 32 is disposed adjacent the second bearing assembly 30. The gear box 32 is preferably comprised of a drive shaft assembly 34 which is received by a first miter gear 36. The first miter gear 36 is meshed with a perpendicularly disposed second miter gear 38 which is coupled with the tensioning screw 24. Accordingly, as the drive shaft assembly 34 is rotated, the first and second miter gears cooperate to rotate the tensioning screw 24. A crank handle 40, or similarly operating manual or automatically powered device, is removably engaged with the drive shaft assembly 34. Accordingly, as the crank handle 40 is rotated, the gear box assembly 32 operates to rotate the tensioning screw 24. A tensioning nut 42 is threadably received by the tensioning screw 24 within the tube 26. Accordingly, as the tensioning screw 24 is rotated, the tensioning nut 42 is moved along the length of the tensioning screw 24.

Figure 7:
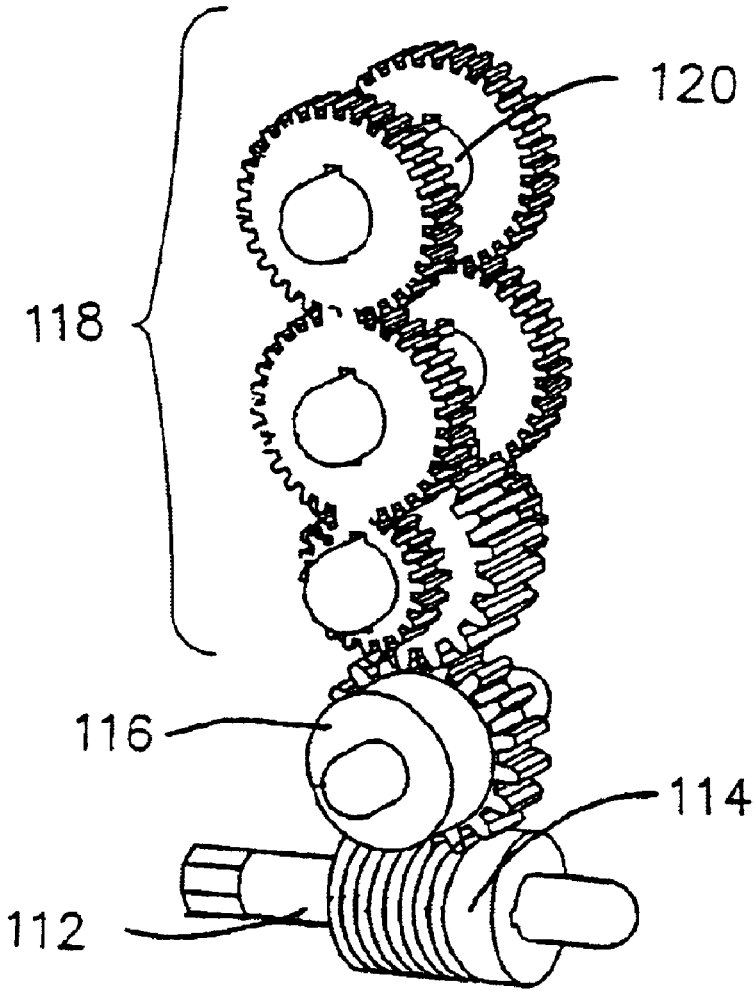
FIG. 7 is a partial isometric view of an alternate net tensioning system of the present invention.

It is contemplated that the net tensioning system could be comprised of a worm gear drive assembly in place of the tensioning screw 24, gear box 32 and tensioning nut 42. An example of such a worm gear drive assembly is depicted in FIG. 7. The worm gear drive assembly is preferably provided with a drive shaft 112 having a drive gear 114 which cooperates with a worm gear 116 to rotate a mating gear assembly 118.

The mating gear assembly is preferably provided with a strap shaft 120, on which the tensioning line 44 could be wound and unwound to apply tension to the net 12.

The tensioning nut 42 is preferably coupled to the net 12 via a tensioning line 44. It is contemplated, however, that the tensioning line 44 could simply be replaced using an elongated free end of the upper line extending from the net 12. The tensioning line 44 is preferably coupled with the net using a hook 46 or similar structure that provides quick and easy engagement with the upper portion of the net 12. The tensioning line 44 enters the tensioning system 22 and is preferably engaged first by the roller guide 48 and then a plurality of bushings 50, which guide the tensioning strap 44 to the tensioning nut bushing 52 and up to an anchor 54. Accordingly, it can be seen in FIG. 2 that as the tensioning nut 42 is advanced and retracted along the length of the tensioning screw 24, the tensioning line 44 is withdrawn and extended from the tensioning system 22 to adjust the tension applied to the net 12 as desired. Although it is contemplated that a second net tensioning system 22 could be disposed within the opposing standard supporting the net 12, it is also contemplated that a fixed tensioning strap assembly could also be provided in its place.

Figure 4:
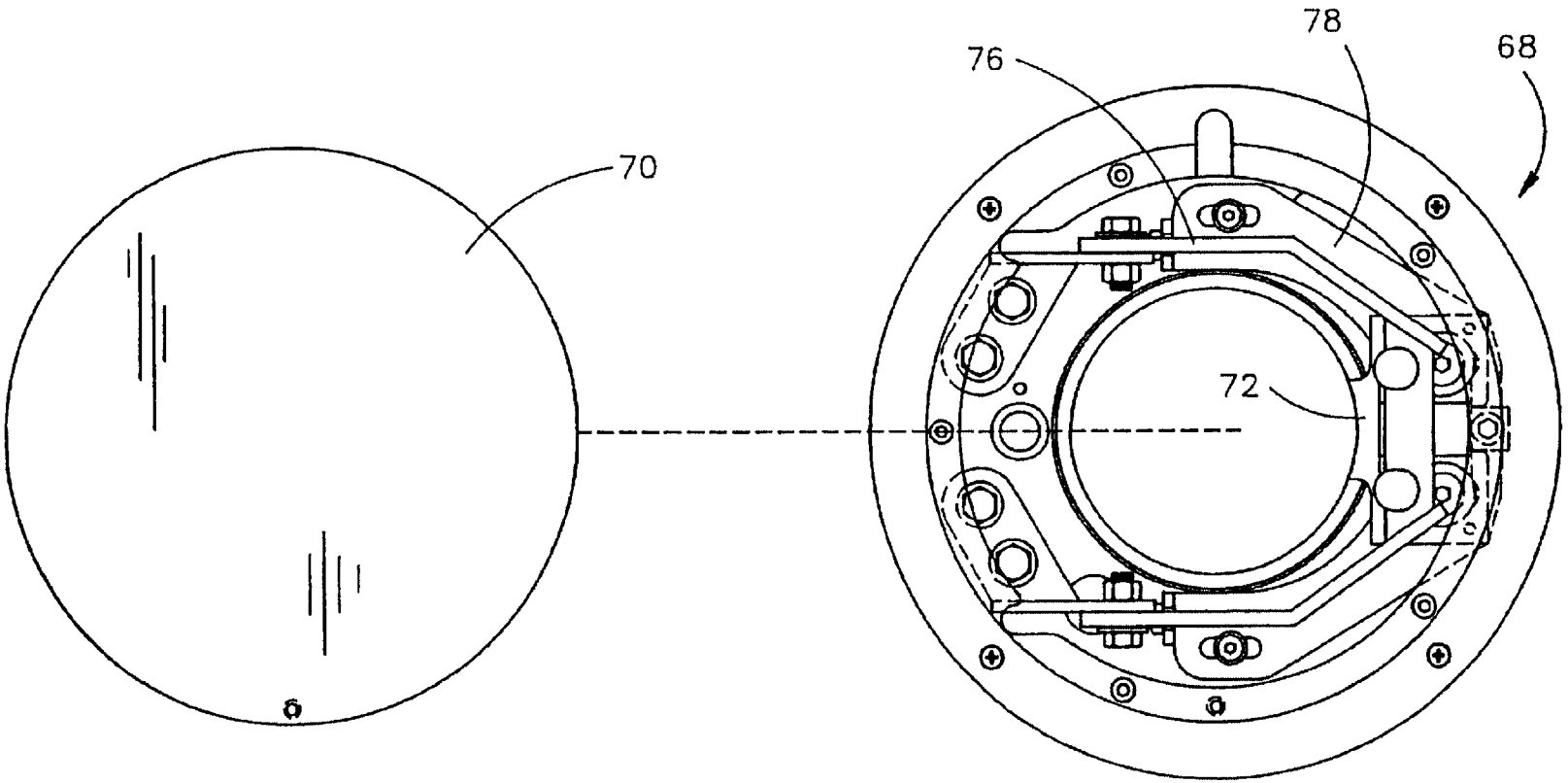
FIG. 4 is a top view of the base receptacle assembly of FIG. 3.

The net support 16 is preferably telescopically received within and extended from a lower support 56, having an upper end 58 and a lower end portion 60. A stop collar 61 is preferably secured within the upper end 58 of the lower support 56 that is sized to slide along the length of the net support 16 until meeting the enlarged stop 63 at the lower end portion 20 of the net support 16. In this manner, the net support 16 is prevented from complete withdrawal from within the lower support 56. The lower support 56 is telescopically received within and selectively extendable from an elongated housing 62, having an upper end portion 64 and a lower end portion 66. A base assembly 68 is preferably positioned adjacent the upper end portion 64 of the housing 66 and generally flush with the playing surface 14. A cover 70 is provided for covering the base assembly 68 (as depicted in FIG. 4) when the standard 10 is fully retracted beneath the playing surface 14. In this manner, a generally uniform playing surface 14 is provided that will not interfere with alternate uses of the playing surface 14.

The base assembly 68 is generally provided with a locking lug 72 which is slidably mounted within the base assembly 68 to move perpendicularly toward and away from the standard 10. A spring 74 can be provided to bias the locking lug 72 toward the standard 10. A locking lever 76 is pivotably coupled with the base assembly 68 to selectively engage an activator plate 78 to which the locking lug 72 is secured. Accordingly, activation of the locking lever 76 to engage the activator plate 78 will move the locking lug 72 away from the standard 10, allowing the same to extend from or retract within the housing 62.

A plurality of height adjustment stops 80 are disposed along the length of the outer surface of the lower support 56. Although the height adjustment stops 80 are depicted as a collar having an engagement edge 82, it is only necessary to provide sufficient structure to engage the locking lug 72 so that retraction of the standard 10 inot the housing 62 is prevented. In the embodiment depicted in FIG. 1, guide collars 84 and 86 are provided to help stabilize the lower support 56 within the housing 62. Where collars or similar structures are used as the height adjustment stops 80, it is preferred that the edge portions 83 that do not engage the locking lug 72 be beveled, as indicated in FIG. 1, to permit the smooth passage of the locking lug 72. It is preferred that the positioning of the height adjustment stops 80 along the length of the lower support 56 coordinate with one or more pre-selected height adjustments for the standard 10. For example, FIG. 6A depicts the standard 10 as it could be used to support the game net 12 at a height suitable for use in an adult volleyball game. This position is attained by the engagement of the locking lug 72 beneath the engagement edge 82 of the lowermost height adjustment stop 80 on the lower support 56. FIG. 6B depicts the standard 10 as supporting the net 12 at a height suitable for playing tennis. This position is attained by engaging the locking lug 72 with the engagement edge 82 of the uppermost height adjustment stop 80 on the lower support 56. Likewise, FIG. 6C depicts the standard 10 as the same could be positioned at a height intermediate the "volleyball" height of FIG. 6A and the "tennis" height of FIG. 6B, so that a youth league could play volleyball or some other sport.

A plunger assembly 88 is preferably disposed within the net support 16, adjacent the net tensioning system 22. The plunger assembly 88 is generally provided with a plunger 90 that is biased outwardly from the plunger assembly 88 using a spring or other similar structure. The plunger 90 is first positioned to extend outwardly from an opening 92 in the side of the net support 16. The plunger 90 remains in this retracted state until the net support 16 is extended from within the lower support 56 a sufficient distance for the plunger 90 to pass the upper end portion 58 of the lower support 56. As the plunger 90 passes that point, it fully extends to provide a positive stop, preventing the net support 16 from retracting within the lower support 56 at an undesirable time. The plunger 90 can be selectively moved to its retracted position by either manually depressing the same or by depressing a pin 94 that is operatively engaged with the plunger 90 using a bell crank or similar device.

Although it is contemplated that the standard 10 could be manually extended from and retracted within the housing 62, it is preferred that power cylinder mechanics such as a pneumatic or hydraulic system be employed to automate the same. Preferably, a pneumatic line 96 would be disposed between a pneumatic coupler 98 at the base assembly 68 and a fitting 100 at the lower end portion 66 of the housing 62. It is contemplated, however, that the pneumatic line 96 could be coupled directly to a remote pneumatic source via lines that run away from the standard 10 beneath the playing surface 14. With the pneumatic source being coupled to the lower end portion 66 of the housing 62, piston seals 102 and 104 are coupled to the lower end portions 60 and 20 of the lower support 56 and the net support 16, respectively. It is preferred that the piston seal 102 be positioned to be in engagement with the inner surface of the housing 62 (and likewise that the piston seal 104 be placed in engagement with the inner surface of the lower support 56) to properly seal the openings of the system. Accordingly, as pneumatic (or hydraulic, when desired) pressure is applied to the system, the net support 16 will extend from the lower support 56, which will extend from the housing 62. Once the standard 10 is at full extension, the addition of pneumatic pressure can be stopped. The user may then slowly release the pneumatic pressure until the lower support 56 is positioned adjacent the locking lug 72 at the desired height, in which the locking lug 72 is allowed to engage the recess 86 or other provided structure to support the standard 10 in position. When it is desired to store the standard 10, the user simply disengages the locking lug 72 with the locking lever 76 and further retracts the plunger 90 within the net support 16. The remaining pneumatic pressure can then be slowly released, permitting the lower support 56 to retract within the housing 62 and the net support 16 to retract within the lower support 56. Resilient bumper members 105 can be disposed onto the lower end portions 20 and 60 of the net support 16 and lower support 56 to help cushion the controlled retraction of the standard 10. With the standard 10 being fully retracted beneath the playing surface 14, the locking lever 76 can be disengaged, allowing the locking lug 72 to position itself forwardly, just above the upper end portion 18 of the net support 16, thus preventing its unintended extension of the standard 10 beyond the base assembly 68.

Figure 5:
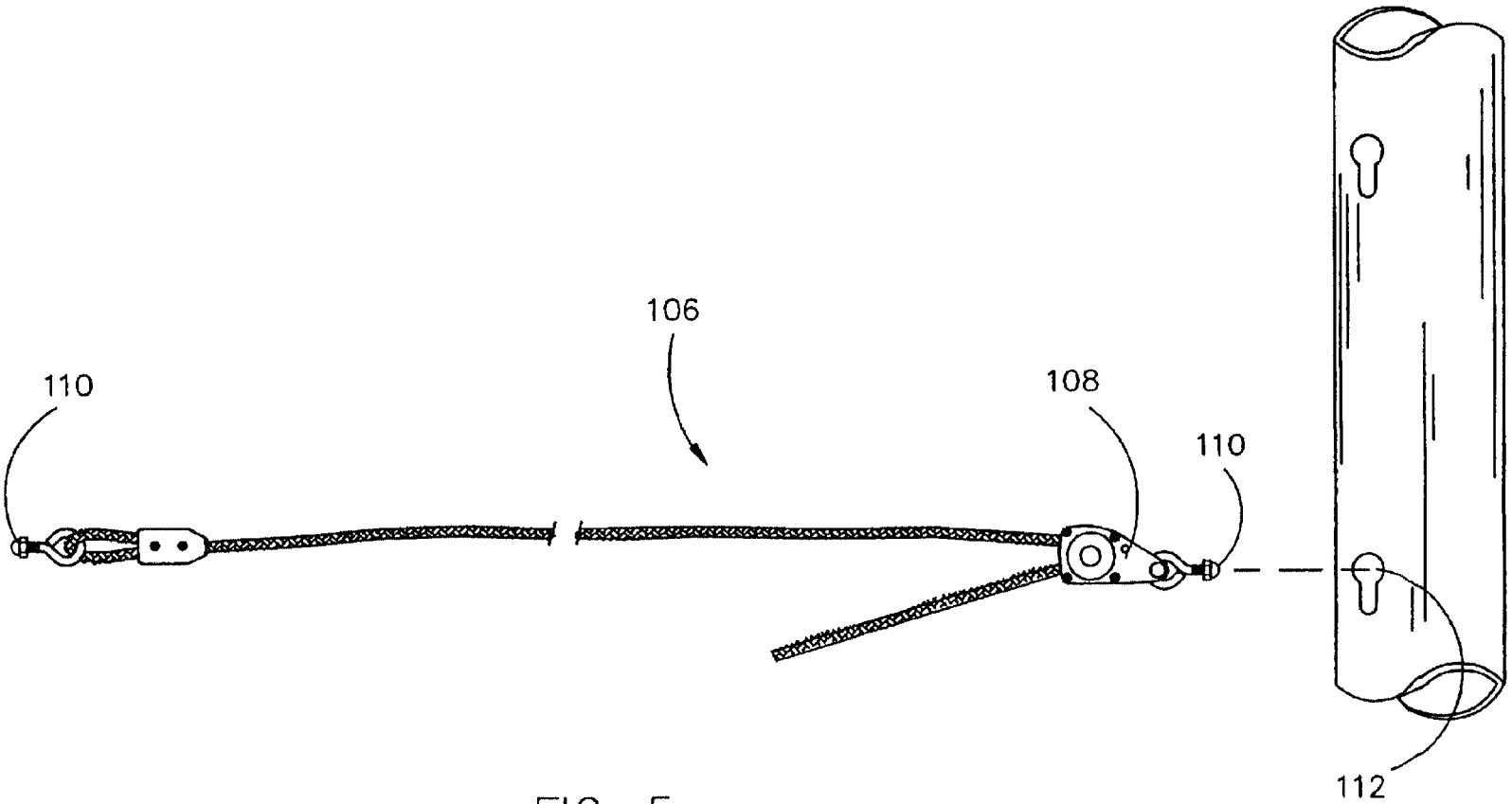
FIG. 5 is a partial isometric view of one embodiment of the bottom rope assembly of the present invention.

When the user has fully extended the standard 10 so that it is at the desired playing height with respect to the playing surface 14, the user may then couple the upper end portion of the net 12 to the hook 46 of the net tensioning system 22. This is then performed on the opposite side of the net to the accompanying net standard. The user disposes the crank handle 40 within the gear box 32 and rotates the crank handle 40 until the proper amount of tension has been placed on the upper end portion of the net 12. It is contemplated that the line extending through the lower end portion of the net 12 could simply be tied to the net support 16 to secure the same in place. However, it is preferred that a supplementary net tensioning system 106, similar to that depicted in FIG. 5, be provided. The supplementary net tensioning system 106 is preferably provided with a line winch 108 and a pair of shaped engagement members 110. Keyholes 112 or similar shape of securement opening are preferably formed in the net support 16 to receive the shaped engagement members 110 therein. Once the line is secured, the line winch 108 can be actuated until the lower net line is properly tensioned and secured. The hook 46 and net tensioning system 106 provide a fast and easy means for coupling the net 12 to the standard 10. They further provide a convenient means for keeping a majority of the net mounting components with the net during storage.

It is contemplated that where high degrees of tension are put on the upper and/or lower end portions of the net, the standard 10 may bend slightly in the direction of the net. In order to compensate for this, it is contemplated that the standard 10 could be formed from a reinforced material that would naturally resist the tensioning forces. However, a more economical approach will simply be to use floor ring spacers to pitch the housing 62 and the standard 10 at an angle of only a few degrees so that when the two standards are disposed above the playing surface 14, they are slightly angled away from one another. Then, as the tension is applied to the net 12, the standards will be brought to their generally perpendicularly oriented position with respect to the playing surface.

In the drawings and in the specification, there have been set forth preferred embodiments of the invention; and although specific items are employed, these are used in a generic and descriptive sense only and not for purposes of limitation. Changes in the form and proportion of parts, as well as substitution of equivalents, are contemplated as circumstances may suggest or render expedient without departing from the spirit or scope of the invention as further defined in the following claims.

Thus it can be seen that the invention accomplishes at least all of its stated objectives.

We claim:

1. A standard for supporting a game net above a playing surface, comprising:

an elongated net support having upper and lower end portions and an interior portion;

a tensioning screw having a long axis rotatably secured within the interior portion of said net support;

means for selectively rotating said tensioning screw disposed adjacent said tensioning screw; and a tensioning nut operatively secured to said tensioning screw within the interior portion of said net support so that said tensioning nut travels along the long axis of said tensioning screw in response to said tensioning screw being rotated;

said tensioning nut being operatively coupled with a tensioning line that is operatively connected to the game net so that tension may be selectively applied to the game net.

2. The standard of claim 1 further comprising an elongated housing having upper and lower end portions and an open interior portion; said housing being substantially disposed beneath the playing surface and sized to telescopically receive said net support at least substantially within the interior portion of said housing.

3. The standard of claim 2 further comprising an elongated lower support having upper and lower end portions and an interior portion; said lower support being operatively coupled to said housing so that said lower support can be telescopically moved within and outwardly from the interior portion of said housing, between extended and retracted positions; said lower support further being sized to telescopically receive said net support at least substantially within the interior portion of said lower support.

4. The standard of claim 3 further comprising a base assembly operatively coupled to the upper end portion of said housing and the playing surface.

5. The standard of claim 4 wherein said base assembly is provided with a lock lug which is selectively movable in a transverse direction toward and away from said lower support.

6. The standard of claim 5 wherein said lower support is provided with means between the upper and lower end portions of said lower support for selectively engaging said lock lug to maintain an extended or retracted position and prevent unwanted telescopic movement of said lower support with respect to said housing.

7. The standard of claim 6 wherein said means for selectively engaging said lock lug is positioned along the length of said lower support between the upper and lower end portions of said lower support to define a plurality of pre-set heights of the standard with respect to the playing surface.

8. The standard of claim 6 further comprising a lever operatively coupled with said lock lug so that said lock lug can be selectively moved into and out of engagement with said means for engaging said lock lug.

9. The standard of claim 3 further comprising means for locking said net support in an extended position with respect to said lower support.

10. The standard of claim 3 further comprising power means for generating pressure within said housing to selectively extend said lower support from within said housing and extend said net support from within said lower support.

11. The standard of claim 10 wherein the pressure generated by said power means provides a cushion for selectively and gradually retracting said net support into said lower support said lower support into said housing.

12. The standard of claim 1 further comprising attachment means for releasably coupling a lower portion of the net to said net support.

13. The standard of claim 12 wherein said attachment means is comprised of a keyhole formed in said net support that releasably receives a shaped coupling member operatively coupled to said lower portion of the net.

14. The standard of claim 12 wherein said attachment means is provided with a tensioning ratchet to provide supplemental tension to the net.

15. The standard of claim 1 wherein said net support is disposed at an angle from the perpendicular with respect to the playing surface prior to applying tension to the net.

16. The standard of claim 1 further comprising a roller guide adjacent the upper end portion of said net support and a bushing operatively coupled with said tensioning nut; said roller guide and said bushing being positioned to guide and support said tensioning line.

17. The standard of claim 16 further comprising an anchor for operatively securing one end of said tensioning line with said net support so that said tensioning line is movably coupled with said tensioning nut as said tensioning nut travels along the long axis of said tensioning screw.

18. The standard of claim 17 wherein said anchor is disposed within the interior portion of said net support so that said tensioning line is at least partially disposed within the interior portion of said net support.

19. A standard for supporting a game net above a playing surface, comprising:

an elongated net support having upper and lower end portions and an interior portion;

tensioning means disposed within the interior portion of said net support and operatively coupled with the net for selectively applying tension to the net; and means for selectively actuating said tensioning means.

20. The standard of claim 19 further comprising an elongated housing having upper and lower end portions and an open interior portion; said housing being substantially disposed beneath the playing surface and sized to telescopically receive said net support at least substantially within the interior portion of said housing.

21. The standard of claim 20 further comprising an elongated lower support having upper and lower end portions and an interior portion; said lower support being operatively coupled to said housing so that said lower support can be telescopically moved within and outwardly from the interior portion of said housing, between extended and retracted positions; said lower support further being sized to telescopically receive said net support at least substantially within the interior portion of said lower support.

22. The standard of claim 21 further comprising means for selectively positioning said net support at one of a plurality of pre-set heights above the playing surface.

23. The standard of claim 22 further comprising power means for generating pressure within said housing to selectively extend said lower support from within said housing and extend said net support from within said lower support; said power means provides a cushion for selectively and gradually retracting said net support into said lower support into said housing.

24. The standard of claim 19 further comprising attachment means for releasably coupling a lower portion of the net to said net support.

* * * * *